US010727588B2

(12) United States Patent
Deng et al.

(10) Patent No.: US 10,727,588 B2
(45) Date of Patent: Jul. 28, 2020

(54) MOBILE DEVICE

(71) Applicant: Quanta Computer Inc., Taoyuan (TW)

(72) Inventors: Ying-Cong Deng, Taoyuan (TW); Chung-Hung Lo, Taoyuan (TW); Chin-Lung Tsai, Taoyuan (TW); Ching-Hai Chiang, Taoyuan (TW); Kuan-Hsien Lee, Taoyuan (TW); Yi-Ling Tseng, Taoyuan (TW); Chung-Ting Hung, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 9 days.

(21) Appl. No.: 16/285,516

(22) Filed: Feb. 26, 2019

(65) Prior Publication Data

US 2020/0136251 A1 Apr. 30, 2020

(30) Foreign Application Priority Data

Oct. 30, 2018 (TW) ..... 107138356 A

(51) Int. Cl.
*H01Q 5/15* (2015.01)
*H01Q 5/30* (2015.01)
(Continued)

(52) U.S. Cl.
CPC ..... *H01Q 5/15* (2015.01); *H01Q 1/241* (2013.01); *H01Q 1/242* (2013.01); *H01Q 1/243* (2013.01);
(Continued)

(58) Field of Classification Search
CPC ..... H01Q 1/243; H01Q 1/38; H01Q 9/0421; H01Q 5/371; H01Q 5/378; H01Q 9/0442;
(Continued)

(56) References Cited

U.S. PATENT DOCUMENTS 4,978,965 A * 12/1990 Mohuchy ..... H01Q 13/085 343/727
6,359,596 B1 * 3/2002 Claiborne ..... H01Q 1/38 343/795

(Continued)

FOREIGN PATENT DOCUMENTS

TW M303502 U 12/2006
TW 201140939 A 11/2011
TW 201409841 A 3/2014

OTHER PUBLICATIONS

Chinese language office action dated Nov. 1, 2019, issued in application No. TW 107138356.

*Primary Examiner* — Vibol Tan
(74) *Attorney, Agent, or Firm* — McClure, Qualey & Rodack, LLP

(57) ABSTRACT

A mobile device includes a main circuit board, a PCB (Printed Circuit Board), a feeding connection element, a grounding connection element, a first radiation element, a second radiation element, a third radiation element, a fourth radiation element, and a fifth radiation element. The first radiation element is coupled to the feeding connection element. The second radiation element is coupled to the feeding connection element. The third radiation element is coupled to the grounding connection element. The fourth radiation element is coupled to the first radiation element. The fifth radiation element is coupled to the feeding connection element. The feeding connection element, the grounding connection element, the first radiation element, and the second radiation element are disposed on the main circuit board. The third radiation element, the fourth radiation element, and the fifth radiation element are disposed on the PCB.

10 Claims, 7 Drawing Sheets

(51) Int. Cl.

| | |
|---|---|
| ***H01Q 5/40*** | (2015.01) |
| ***H01Q 1/20*** | (2006.01) |
| ***H01Q 5/371*** | (2015.01) |
| ***H01Q 5/328*** | (2015.01) |
| ***H01Q 1/24*** | (2006.01) |
| ***H01Q 1/36*** | (2006.01) |
| ***H01Q 1/38*** | (2006.01) |

(52) U.S. Cl.
CPC ..... *H01Q 1/36* (2013.01); *H01Q 1/38* (2013.01); *H01Q 5/30* (2015.01); *H01Q 5/328* (2015.01); *H01Q 5/371* (2015.01); *H01Q 5/40* (2015.01)

(58) Field of Classification Search
CPC ..... H01Q 13/10; H01Q 1/2283; H01Q 21/30; H01Q 5/30; H01Q 5/392; H01Q 9/285; H01Q 1/521; H01Q 5/328; H01Q 5/364; H01Q 9/0407; H01Q 1/241; H01Q 5/00; H01Q 9/40; H01Q 1/242; H01Q 1/525; H01Q 5/20; H01Q 5/385; H01Q 9/045; H01Q 9/26; H01Q 1/526; H01Q 5/50; H01Q 9/0457; H01Q 13/106; H01Q 19/005; H01Q 5/335; H01Q 9/04; H01Q 9/065; H01Q 1/523; H01Q 21/0075; H01Q 21/065; H01Q 5/357; H01Q 5/15
See application file for complete search history.

(56) References Cited

U.S. PATENT DOCUMENTS

| | | | | |
|---|---|---|---|---|
| 6,906,669 | B2 * | 6/2005 | Sabet | H01Q 1/36 343/700 MS |
| 7,015,864 | B2 * | 3/2006 | Lin | H01Q 1/243 343/700 MS |
| 7,180,461 | B2 * | 2/2007 | Petropoulos | H01Q 1/241 343/793 |
| 7,471,252 | B2 * | 12/2008 | Onaka | H01Q 1/243 343/702 |
| 7,589,681 | B2 * | 9/2009 | Hung | H01Q 1/243 343/702 |
| 8,907,857 | B2 * | 12/2014 | Nysen | H01Q 5/40 343/730 |
| 8,981,999 | B2 * | 3/2015 | Liu | H01Q 5/35 343/700 MS |
| 10,542,130 | B1 * | 1/2020 | Lo | H01Q 1/243 |
| 2006/0244665 | A1 * | 11/2006 | Tung | H01Q 1/243 343/702 |
| 2010/0060525 | A1 * | 3/2010 | Yang | H01Q 1/243 343/700 MS |
| 2010/0177005 | A1 * | 7/2010 | Hsiao | H01Q 9/285 343/845 |
| 2015/0123874 | A1 | 5/2015 | Chan et al. | |

* cited by examiner

MOBILE DEVICE

CROSS REFERENCE TO RELATED APPLICATIONS

This application claims priority of Taiwan Patent Application No. 107138356 filed on October 30, the entirety of which is incorporated by reference herein.

BACKGROUND OF THE INVENTION

Field of the Invention

The disclosure generally relates to a mobile device, and specifically, to a mobile device and an antenna structure therein.

Description of the Related Art

With the progress being made in mobile communication technology, mobile devices such as portable computers, mobile phones, tablet computers, multimedia players, and other hybrid functional mobile devices have become common. To meet users' needs, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

An antenna is an indispensable element in a mobile device for supporting wireless communication. However, the interior space of the mobile device is limited, and there is insufficient area for accommodating the necessary antenna element. Accordingly, it has become a critical challenge for engineers to design a small-size, wideband antenna element.

BRIEF SUMMARY OF THE INVENTION

In a preferred embodiment, the disclosure is directed to a mobile device including a main circuit board, a PCB (Printed Circuit Board), a feeding connection element, a grounding connection element, a first radiation element, a second radiation element, a third radiation element, a fourth radiation element, and a fifth radiation element. The feeding connection element has a feeding point. The first radiation element is coupled to the feeding connection element. The grounding connection element has a grounding point. The grounding connection element is adjacent to the first radiation element. The second radiation element is coupled to the feeding connection element. The third radiation element is coupled to the grounding connection element. The fourth radiation element is coupled to the first radiation element. The fifth radiation element is coupled to the feeding connection element. The feeding connection element, the grounding connection element, the first radiation element, and the second radiation element are disposed on the main circuit board. The third radiation element, the fourth radiation element, and the fifth radiation element are disposed on the PCB. An antenna structure is formed by the feeding connection element, the grounding connection element, the first radiation element, the second radiation element, the third radiation element, the fourth radiation element, and the fifth radiation element.

In some embodiments, the main circuit board and the PCB are substantially perpendicular to each other.

In some embodiments, the feeding connection element is positioned between the first radiation element and the second radiation element. The first radiation element and the second radiation element substantially extend in opposite directions.

In some embodiments, a first coupling gap is formed between the first radiation element and the grounding connection element. The width of the first coupling gap is shorter than 1 mm.

In some embodiments, the third radiation element, the fourth radiation element, and the fifth radiation element substantially extend in the same direction. The fourth radiation element is at least partially surrounded by the third radiation element and the fifth radiation element.

In some embodiments, the mobile device further includes a metal element coupled to the third radiation element. The metal element is substantially perpendicular to the PCB and is substantially parallel to the main circuit board.

In some embodiments, the antenna structure covers a first frequency band, a second frequency band, and a third frequency band. The first frequency band is from about 700 MHz to about 960 MHz. The second frequency band is from about 1427 MHz to about 1510 MHz. The third frequency band is from about 1710 MHz to about 2700 MHz.

In some embodiments, the grounding connection element, the third radiation element, and the metal element are excited to generate the first frequency band.

In some embodiments, the first radiation element and the fourth radiation element are excited to generate the second frequency band.

In some embodiments, the feeding connection element, the second radiation element, and the fifth radiation element are excited to generate the third frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are described in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
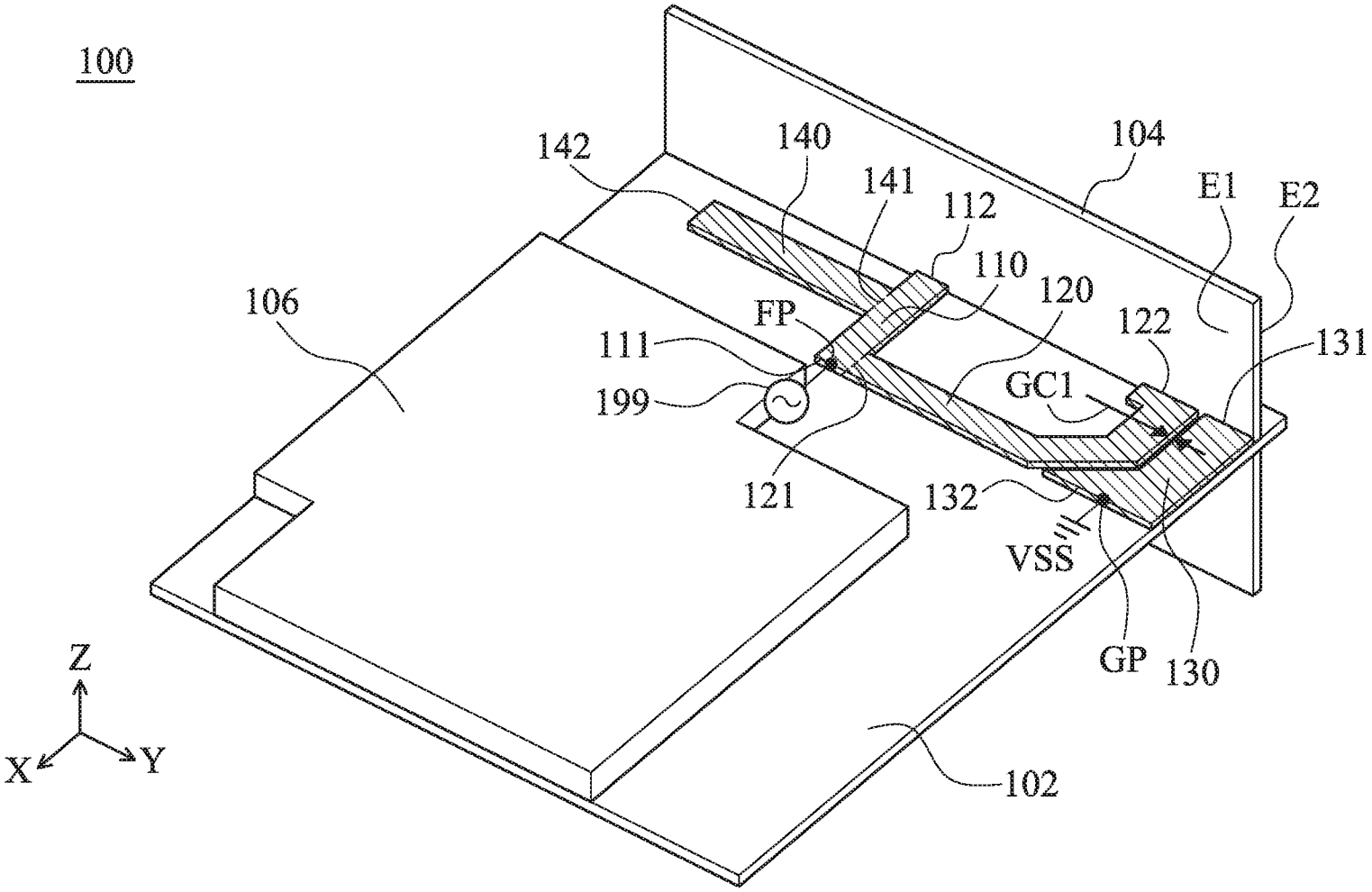
FIG. 1 is a perspective view of a mobile device according to an embodiment of the invention.
Figure 2:
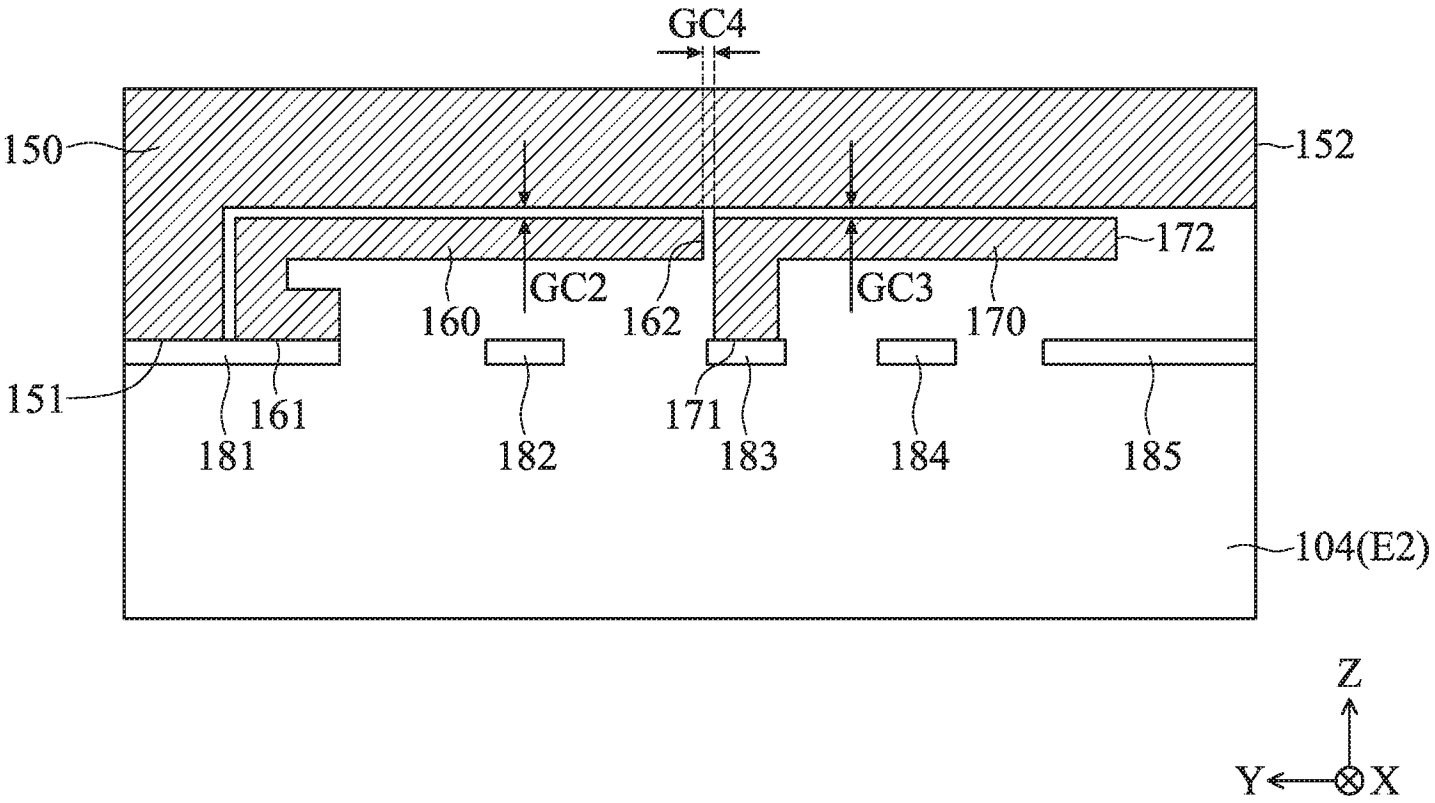
FIG. 2 is a top view of a PCB (Printed Circuit Board) according to an embodiment of the invention.

FIG. 1 is a perspective view of a mobile device 100 according to an embodiment of the invention. The mobile device 100 may be a smartphone, a tablet computer, or a notebook computer. A shown in FIG. 1, the mobile device 100 includes a main circuit board 102, a PCB (Printed Circuit Board) 104, a feeding connection element 110, a first radiation element 120, a grounding connection element 130, a second radiation element 140, a third radiation element 150 (as shown in FIG. 2), a fourth radiation element 160 (as shown in FIG. 2), and a fifth radiation element 170 (as shown in FIG. 2). The main circuit board 102 may be configured to carry a circuit element 106. The circuit element 106 may have a shielding housing and include a variety of circuits therein, such as a processor or a microcontroller. The shape and type of the circuit element 106 are not limited in the invention. In alternative embodiments, the circuit element 106 is removed from the main circuit board 102. The feeding connection element 110, the first radiation element 120, the grounding connection element 130, the second radiation element 140, the third radiation element 150, the fourth radiation element 160, and the fifth radiation element 170 may all be made of metal materials, such as copper, silver, aluminum, iron, or their alloys.

In some embodiments, the main circuit board 102 and the PCB 104 are adjacent to each other and are substantially perpendicular to each other. It should be noted that the term "adjacent" or "close" over the disclosure may mean that the distance (spacing) between two corresponding elements is smaller than a predetermined distance (e.g., 2 mm or the shorter), or it may mean that the two corresponding elements touch each other directly (i.e., the aforementioned distance/spacing therebetween is reduced to 0). Specifically, the feeding connection element 110, the first radiation element 120, the grounding connection element 130, and the second radiation element 140 are all disposed on the main circuit board 102. The third radiation element 150, the fourth radiation element 160, and the fifth radiation element 170 are all disposed on the PCB 104. In a preferred embodiment, an antenna structure is formed by the feeding connection element 110, the first radiation element 120, the grounding connection element 130, the second radiation element 140, the third radiation element 150, the fourth radiation element 160, and the fifth radiation element 170. That is, the antenna structure may extend from the main circuit board 102 onto the PCB 104, and it may be considered as a 3D (Three Dimensional) antenna structure.

The components may be arranged on the main circuit board 102 as follows. The feeding connection element 110 may substantially have a straight-line shape. The feeding connection element 110 has a first end 111 and a second end 112. A feeding point FP is positioned at the first end 111 of the feeding connection element 110. The feeding point FP may be coupled to a signal source 199. For example, the signal source 199 may be an RF (Radio Frequency) module for exciting the antenna structure of the mobile device 100. The first radiation element 120 may substantially have an inverted C-shape. The first radiation element 120 has a first end 121 and a second end 122. The first end 121 of the first radiation element 120 is coupled to the first end 111 of the feeding connection element 110 (or the feeding point FP). The grounding connection element 130 may substantially have an inverted L-shape or a J-shape. The grounding connection element 130 is completely separate from the first radiation element 120. A first coupling gap GC1 may be formed between the first radiation element 120 and the grounding connection element 130. The grounding connection element 130 has a first end 131 and a second end 132. The first end 131 of the grounding connection element 130 is adjacent to the second end 122 of the first radiation element 120. A grounding point GP is positioned at the second end 132 of the grounding connection element 130. The grounding point GP may be coupled to a ground voltage VSS. For example, the ground voltage VSS may be provided by a system ground plane (not shown) of the mobile device 100. In some embodiments, the grounding connection element 130 has a width-varying structure, and a triangular extension portion is positioned at the second end 132 of the grounding connection element 130, such that the width of the second end 132 of the grounding connection element 130 is greater than the width of the first end 131 of the grounding connection element 130. In alternative embodiments, the grounding connection element 130 may be an equal-width structure, and the aforementioned triangular extension portion may be removed. The second radiation element 140 may substantially have a straight-line shape. The second radiation element 140 has a first end 141 and a second end 142. The first end 141 of the second radiation element 140 is coupled to a median portion of the feeding connection element 140 (the median portion is positioned between the first end 111 and the second end 112 of the feeding connection element 110). The second end 142 of the second radiation element 140 is an open end. Specifically, the feeding connection element 110 may be positioned between the first radiation element 120 and the second radiation element 140. The second end 122 of the first radiation element 120 and the second end 142 of the second radiation element 140 may substantially extend in opposite directions (e.g., the second end 122 of the first radiation element 120 may substantially extend in the direction of the +Y-axis, and the second end 142 of the second radiation element 140 may substantially extend in the direction of the −Y-axis).

FIG. 2 is a top view of the PCB 104 according to an embodiment of the invention. Please refer to FIG. 1 and FIG. 2 together. The components may be arranged on the PCB 104 as follows. The PCB 104 has a first surface E1 and a second surface E2 which are opposite to each other. The first surface E1 of the PCB 104 directly touches an edge of the main circuit board 102. The third radiation element 150, the fourth radiation element 160, and the fifth radiation element 170 are all disposed on the second surface E2 of the PCB 104. The third radiation element 150 may substantially have an inverted L-shape. The third radiation element 150 has a first end 151 and a second end 152. The first end 151 of the third radiation element 150 is coupled to the first end 131 of the grounding connection element 130. The second end 152 of the third radiation element 150 is an open end. The fourth radiation element 160 may substantially have an inverted L-shape. The fourth radiation element 160 has a first end 161 and a second end 162. The first end 161 of the fourth radiation element 160 is coupled to the second end 122 of the first radiation element 120. The second end 162 of the fourth radiation element 160 is an open end. The fifth radiation element 170 may substantially have an inverted L-shape. The fifth radiation element 170 has a first end 171 and a second end 172. The first end 171 of the fifth radiation element 170 is coupled to the second end 112 of the feeding connection element 110. The second end 172 of the fifth radiation element 170 is an open end. Specifically, the third radiation element 150, the fourth radiation element 160, and the fifth radiation element 170 may substantially extend in the same direction (e.g., the second end 152 of the third radiation element 150, the second end 162 of the fourth radiation element 160, and the second end 172 of the fifth radiation element 170 may all extend in the direction of the −Y-axis). The fourth radiation element 160 is at least partially surrounded by the third radiation element 150 and the fifth radiation element 170. The third radiation element 150, the fourth radiation element 160, and the fifth radiation element 170 are completely separate from each other, but they are adjacent to each other. A second coupling gap GC2 may be formed between the third radiation element 150 and the fourth radiation element 160. A third coupling gap GC3 may be formed between the third radiation element 150 and the fifth radiation element 170. A fourth coupling gap GC4 may be formed between the second end 162 of the fourth radiation element 160 and a right-angle bending portion of the fifth radiation element 170. In some embodiments, the PCB 104 has one or more openings 181, 182, 183, 184 and 185. The edge of the main circuit board 102 includes one or more protruding portions. The protruding portions are embedded in the openings, such that the PCB 104 is affixed to the main circuit board 102. The number of openings and the number of protruding portions are not limited in the invention. In alternative embodiments, the PCB 104 and the main circuit board 102 are fixed using different mechanisms (e.g., screws), and the aforementioned openings and protruding portions are removed from the PCB 104 and the main circuit board 102.

Figure 3:
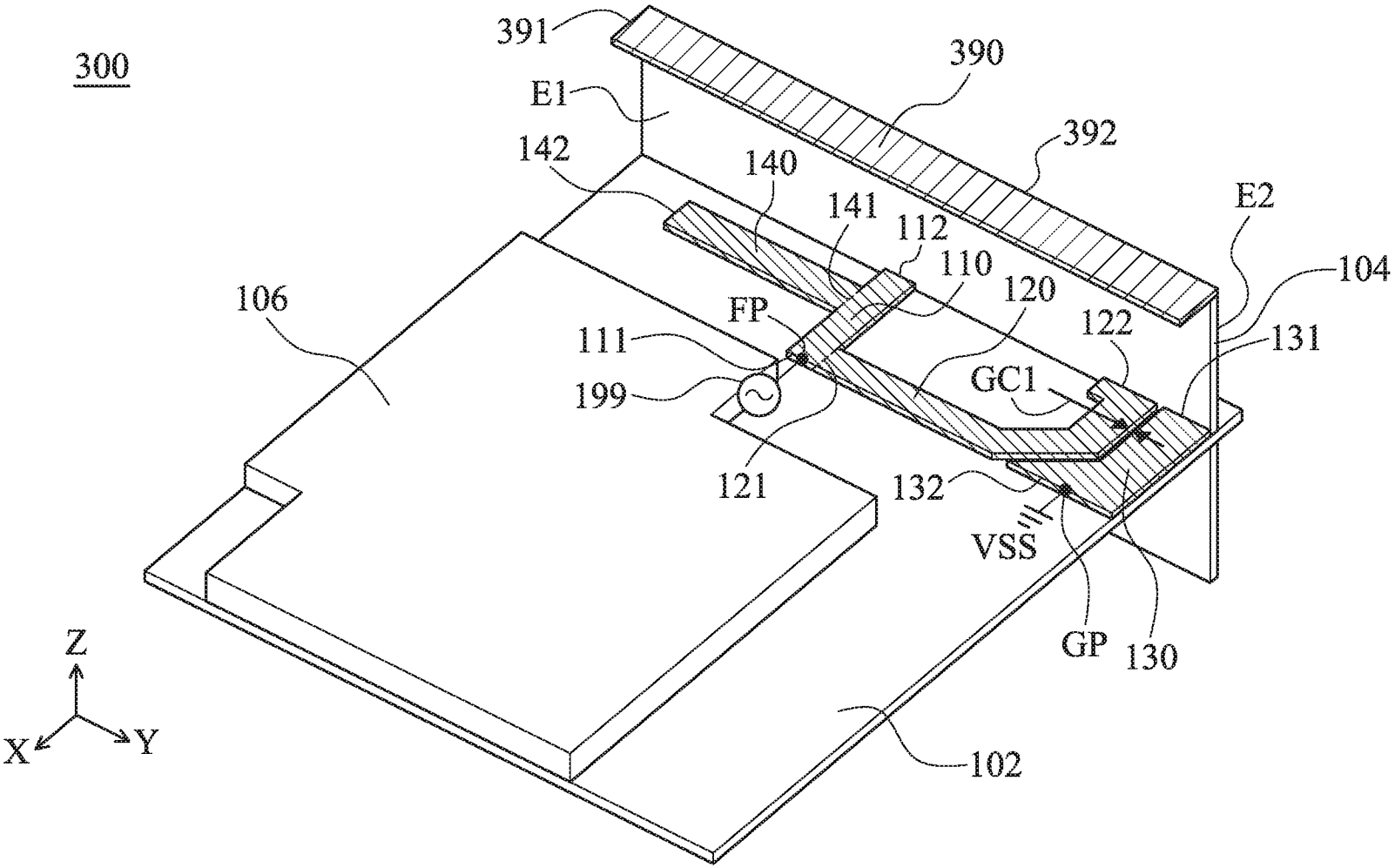
FIG. 3 is a perspective view of a mobile device according to another embodiment of the invention.

FIG. 3 is a perspective view of a mobile device 300 according to another embodiment of the invention. FIG. 3 is similar to FIG. 1. In the embodiment of FIG. 3, an antenna structure of the mobile device 300 further includes a metal element 390. The metal element 390 may be substantially a rectangular metal piece with a short side 391 and a long side 392. The long side 392 of the metal element 390 may be directly coupled to an edge of the third radiation element 150. Specifically, the metal element 390 may be substantially perpendicular to the PCB 104, and the metal element 390 may be substantially parallel to the main circuit board 102. The metal element 390 has a vertical projection on the main circuit board 102, and the vertical projection at least partially overlaps the feeding connection element 110, the first radiation element 120, the grounding connection element 130, and the second radiation element 140. In some embodiments, the length of the long side 392 of the metal element 390 is at least five or more times the length of the short side 391 of the metal element 390. It should be noted that the metal element 390 is an optional element, and it is removable from the mobile device 300 is other embodiments. Other features of the mobile device 300 of FIG. 3 are similar to those of the mobile device 100 of FIG. 1. Accordingly, the two embodiments can achieve similar levels of performance.

Figure 4:
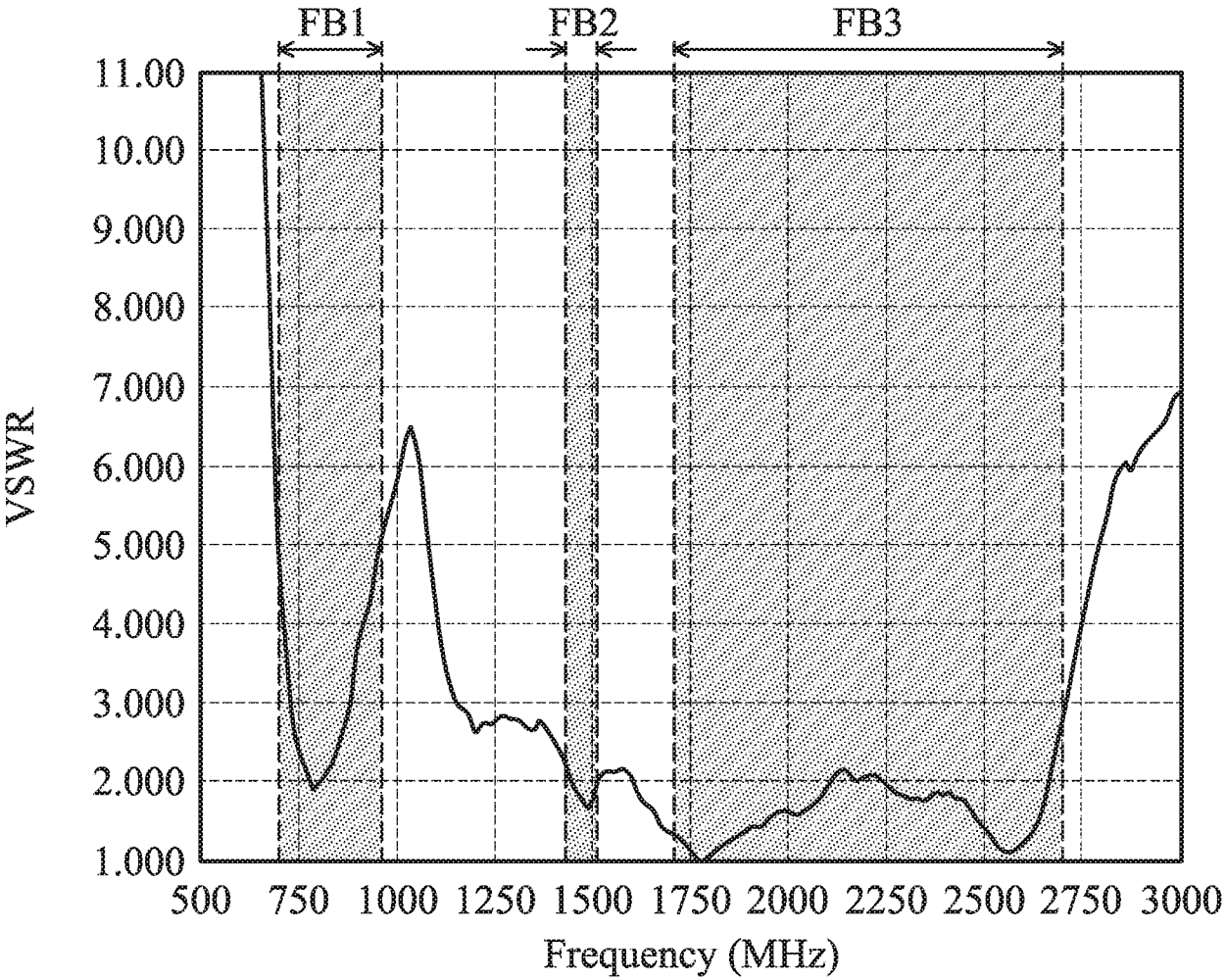
FIG. 4 is a diagram of VSWR (Voltage Standing Wave Ratio) of an antenna structure of a mobile device according to another embodiment of the invention.

FIG. 4 is a diagram of VSWR (Voltage Standing Wave Ratio) of the antenna structure of the mobile device 300 according to another embodiment of the invention. The horizontal axis represents the operation frequency (MHz), and the vertical axis represents the VSWR. According to the measurement of FIG. 4, the antenna structure of the mobile device 300 can cover a first frequency band FB1, a second frequency band FB2, and a third frequency band FB3. For example, the first frequency band FB1 may be from about 700 MHz to about 960 MHz, the second frequency band FB2 may be from about 1427 MHz to about 1510 MHz, and the third frequency band FB3 may be from about 1710 MHz to about 2700 MHz. Therefore, the antenna structure of the mobile device 300 can support at least the wideband operation of LTE (Long Term Evolution).

The operation principle of the antenna structure of the mobile device 300 may be as follows. The grounding connection element 130 is excited by the first radiation element 120 using a coupling mechanism. Thus, the grounding connection element 130, the third radiation element 150, and the metal element 390 are excited to generate the aforementioned first frequency band FB1. The metal element 390 is configured to provide an additional current path, thereby increasing the bandwidth of the first frequency band FB1. The first radiation element 120 and the fourth radiation element 160 are excited to generate the aforementioned second frequency band FB2. In addition, the feeding connection element 110, the second radiation element 140, and the fifth radiation element 170 are excited to generate the aforementioned third frequency band FB3.

The element sizes of the mobile device 300 are as follows. The length of the first radiation element 120 may be longer than the length of the grounding connection element 130, and may also be longer than the length of the second radiation element 140. The length of the third radiation element 150 may be longer than the total length of the fourth radiation element 160 and the fifth radiation element 170. The length of the fourth radiation element 160 may be substantially equal to the length of the fifth radiation element 170. The width of each of the first coupling gap GC1, the second coupling gap GC2, the third coupling gap GC3, and the fourth coupling gap GC4 may be shorter than 1 mm. The total length of the grounding connection element 130 and the third radiation element 150 (i.e., the total length from the second end 132 through the first end 131 and the first end 151 to the second end 152) may be substantially equal to 0.25 wavelength ($\lambda/4$) of the central frequency of the aforementioned first frequency band FB1. The total length of the first radiation element 120 and the fourth radiation element 160 (i.e., the total length from the first end 121 through the second end 122 and the first end 161 to the second end 162) may be substantially equal to 0.25 wavelength ($\lambda/4$) of the central frequency of the aforementioned second frequency band FB2. The total length of the feeding connection element 110 and the second radiation element 140 (i.e., the total length from the first end 111 through the junction between the feeding connection element 110 and the second radiation element 140 to the second end 142) may be substantially equal to 0.25 wavelength ($\lambda/4$) of the highest frequency of the aforementioned third frequency band FB3. The total length of the feeding connection element 110 and the fifth radiation element 170 (i.e., the total length from the first end 111 through the second end 112 and the first end 171 to the second end 172) may be substantially equal to 0.25 wavelength ($\lambda/4$) of the lowest frequency of the aforementioned third frequency band FB3. The above ranges of element sizes are calculated and obtained according to many experiment results, and they help to optimize the operation frequency band and the impedance matching of the antenna structure of the mobile device 300.

Figure 5A:
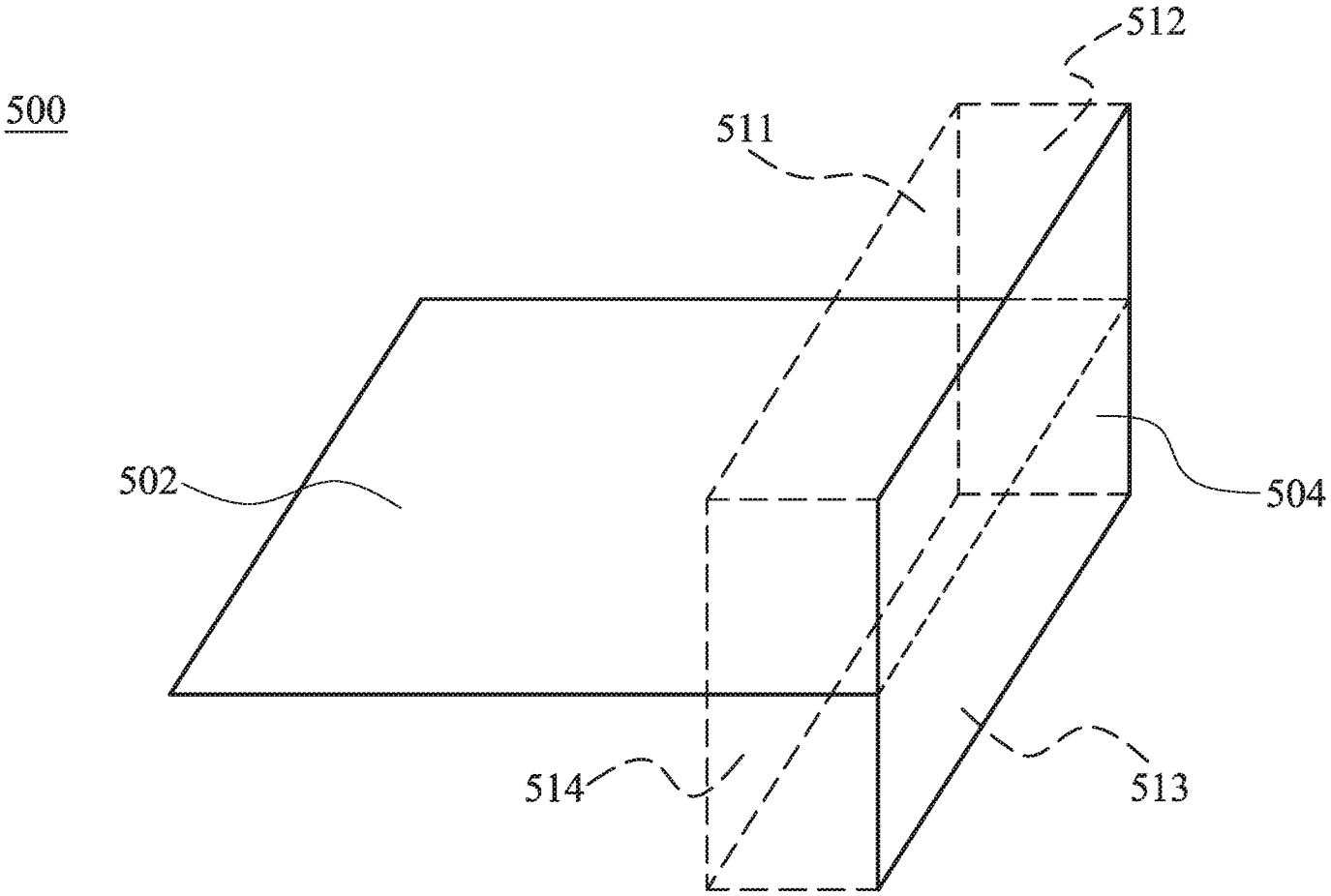
FIG. 5A is a perspective view of a mobile device according to an embodiment of the invention.

It should be noted that the position of the metal element 390 is adjustable according to different requirements and is not limited to the configurations of FIGS. 1 to 4. FIG. 5A is a perspective view of a mobile device 500 according to an embodiment of the invention. In the embodiment of FIG. 5A, a main circuit board 502 is integrated with a PCB 504, and the metal element 390 is connected to any one or more edges of the PCB 504. That is, the metal element 390 may be positioned at one or more of a first position 511, a second position 512, a third position 513, and a fourth position 514 of FIG. 5A.

Figure 5B:
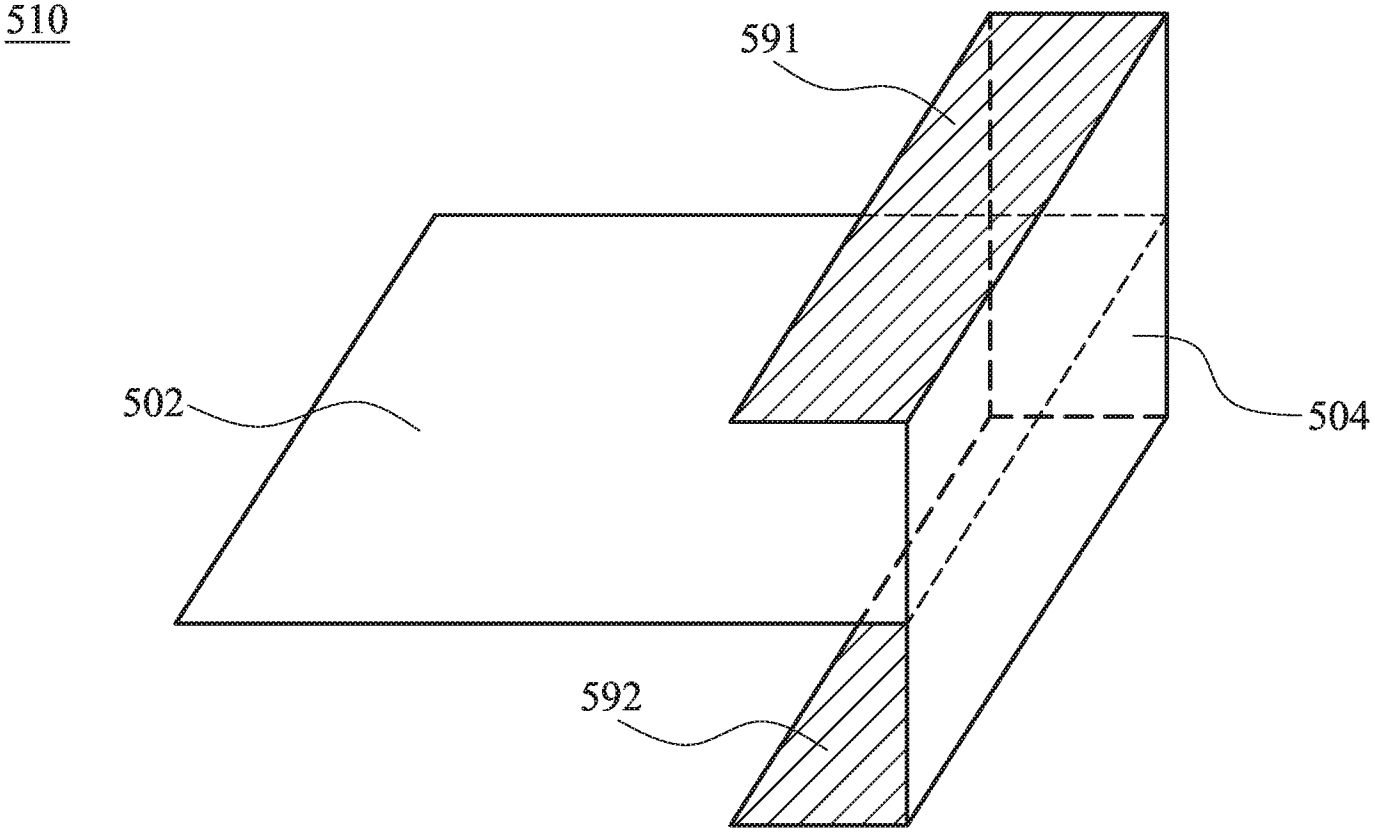
FIG. 5B is a perspective view of a mobile device according to another embodiment of the invention.
Figure 5C:
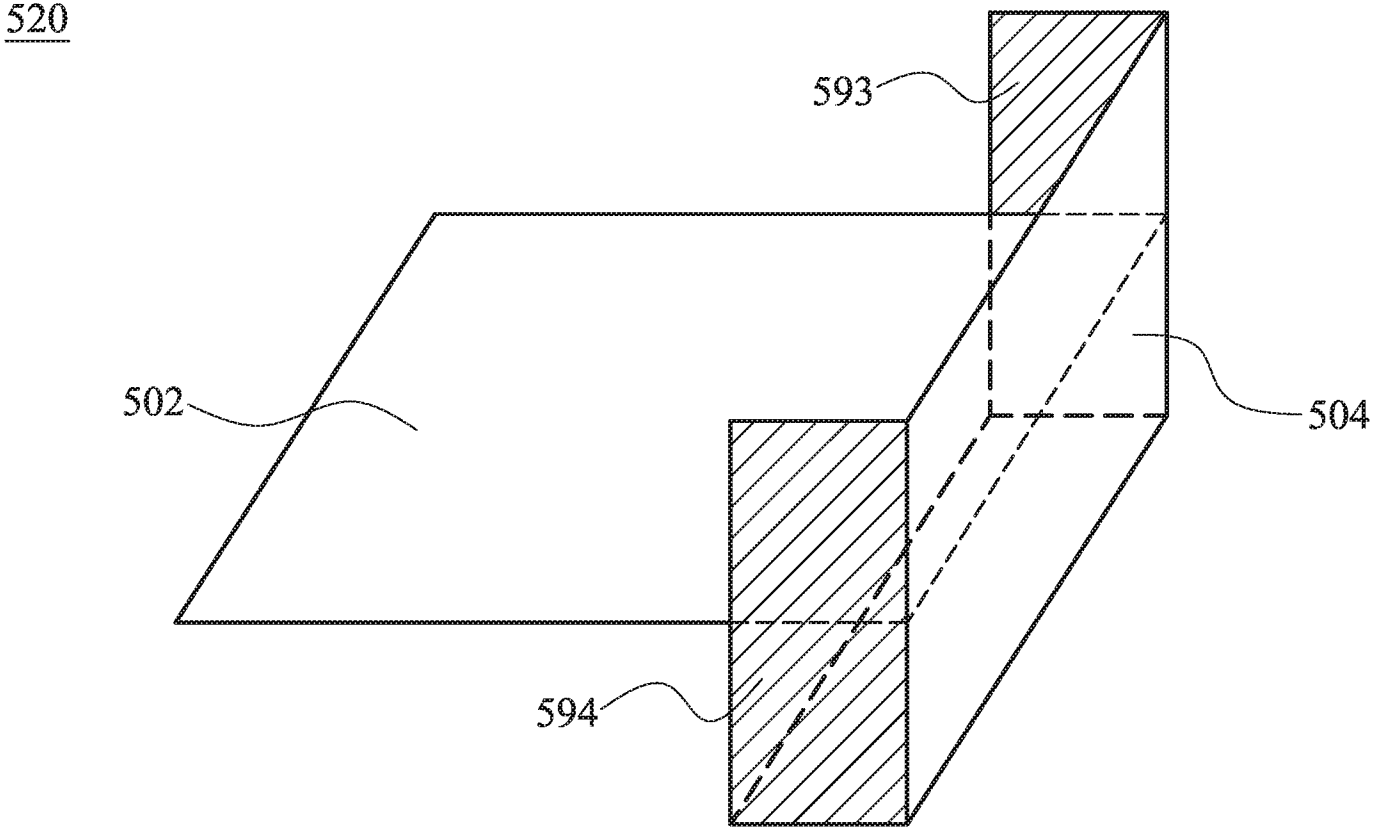
FIG. 5C is a perspective view of a mobile device according to another embodiment of the invention.

FIG. 5B is a perspective view of a mobile device 510 according to another embodiment of the invention. In the embodiment of FIG. 5B, the mobile device 510 includes two metal elements 591 and 592, which are connected to a top side and a bottom side of the PCB 504, respectively. FIG. 5C is a perspective view of a mobile device 520 according to another embodiment of the invention. In the embodiment of FIG. 5C, the mobile device 520 includes two metal elements 593 and 594, which are connected to a left side and a right side of the PCB 504, respectively. To simplify the figures, the other portions of the antenna structures are omitted in FIG. 5A, FIG. 5B, and FIG. 5C, and the detailed patterns of the antenna structures are adjustable according to different positions of the metal elements. Other features of the mobile devices 500, 510 and 520 of FIG. 5A, FIG. 5B and FIG. 5C are similar to those of the mobile device 100 of FIG. 1. Accordingly, these embodiments can achieve similar levels of performance.

The invention proposes a novel mobile device and a novel antenna structure, and the proposed antenna structure can extend onto both a main circuit board and a PCB. Such a design can effectively use design space on the main circuit board and minimize the total size of the antenna structure. In comparison to the prior art, the invention has the advantages of small size, wide bandwidth, low complexity, and low manufacturing cost, and it is suitable for application in a variety of mobile communication devices.

Note that the above element sizes, element shapes, and frequency ranges are not limitations of the invention. An antenna designer can adjust these settings or values according to different requirements. It should be understood that the mobile device and antenna structure of the invention are not limited to the configurations of FIGS. 1-5. The invention may merely include any one or more features of any one or more embodiments of FIGS. 1-5. In other words, not all of the features shown in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. A mobile device, comprising:

a main circuit board;

a PCB (Printed Circuit Board);

a feeding connection element, having a feeding point;

a first radiation element, coupled to the feeding connection element;

a grounding connection element, having a grounding point, wherein the grounding connection element is adjacent to the first radiation element;

a second radiation element, coupled to the feeding connection element;

a third radiation element, coupled to the grounding connection element;

a fourth radiation element, coupled to the first radiation element; and a fifth radiation element, coupled to the feeding connection element;

wherein the feeding connection element, the grounding connection element, the first radiation element, and the second radiation element are disposed on the main circuit board;

wherein the third radiation element, the fourth radiation element, and the fifth radiation element are disposed on the PCB;

wherein an antenna structure is formed by the feeding connection element, the grounding connection element, the first radiation element, the second radiation element, the third radiation element, the fourth radiation element, and the fifth radiation element.

2. The mobile device as claimed in claim 1, wherein the main circuit board and the PCB are substantially perpendicular to each other.

3. The mobile device as claimed in claim 1, wherein the feeding connection element, and the first radiation element and the second radiation element substantially extend in opposite directions.

4. The mobile device as claimed in claim 1, wherein a first coupling gap is formed between the first radiation element and the grounding connection element, and a width of the first coupling gap is shorter than 1 mm.

5. The mobile device as claimed in claim 1, wherein the third radiation element, the fourth radiation element, and the fifth radiation element substantially extend in a same direction, and the fourth radiation element is at least partially surrounded by the third radiation element and the fifth radiation element.

6. The mobile device as claimed in claim 1, further comprising:

a metal element, coupled to the third radiation element, wherein the metal element is substantially perpendicular to the PCB and is substantially parallel to the main circuit board.

7. The mobile device as claimed in claim 6, wherein the antenna structure covers a first frequency band, a second frequency band, and a third frequency band, the first frequency band is from about 700 MHz to about 960 MHz, the second frequency band is from about 1427 MHz to about 1510 MHz, and the third frequency band is from about 1710 MHz to about 2700 MHz.

8. The mobile device as claimed in claim 7, wherein the grounding connection element, the third radiation element, and the metal element are excited to generate the first frequency band.

9. The mobile device as claimed in claim 7, wherein the first radiation element and the fourth radiation element are excited to generate the second frequency band.

10. The mobile device as claimed in claim 7, wherein the feeding connection element, the second radiation element, and the fifth radiation element are excited to generate the third frequency band.

* * * * *